US005845368A

United States Patent [19]

Varga

[11] Patent Number: 5,845,368

[45] Date of Patent: Dec. 8, 1998

[54] SETTING DEVICE FOR A CARDING ENGINE

[76] Inventor: John Varga, Royd Lodge, 2 Lawrence Road, Skircoat Green, Halifax, Great Britain, HX3 0LH

[21] Appl. No.: 750,198

[22] PCT Filed: Jun. 2, 1995

[86] PCT No.: PCT/GB95/01283

§ 371 Date: Feb. 18, 1997

§ 102(e) Date: Feb. 18, 1997

[87] PCT Pub. No.: WO95/33875

PCT Pub. Date: Dec. 14, 1995

[30] Foreign Application Priority Data

| | | | |
|---|---|---|---|
| Jun. 2, 1994 | [GB] | United Kingdom | 9411044 |
| Nov. 4, 1994 | [GB] | United Kingdom | 9422318 |
| Nov. 11, 1994 | [GB] | United Kingdom | 9422815 |

[51] Int. Cl.[6] ..... D01G 15/30

[52] U.S. Cl. ..... 19/103; 19/98

[58] Field of Search ..... 19/98, 102, 103, 19/113, 114, 104

[56] References Cited

U.S. PATENT DOCUMENTS

| | | | |
|---|---|---|---|
| 4,580,318 | 4/1986 | Varga | 19/103 |
| 4,738,005 | 4/1988 | Fahmueller | 19/102 |
| 4,982,478 | 1/1991 | Stahli et al. | 19/102 |
| 5,040,272 | 8/1991 | Fritzsche | 19/102 |
| 5,398,381 | 3/1995 | Schlichter et al. | 19/102 |
| 5,625,924 | 5/1997 | Sauter et al. | 19/102 |

FOREIGN PATENT DOCUMENTS

| | | |
|---|---|---|
| 0144184A1 | 6/1985 | European Pat. Off. . |
| 9313633.1 | 12/1993 | Germany . |
| 4262610A1 | 4/1994 | Germany . |
| 1239119 | 9/1989 | Japan . |
| WO93/07314 | 4/1993 | WIPO . |

*Primary Examiner*—C. D. Crowder
*Assistant Examiner*—Larry D. Womell, Jr.
*Attorney, Agent, or Firm*—Madson & Metcalf

[57] ABSTRACT

A carding engine having a main toothed cylinder, a taker-in, a doffer, and a revolving flats assembly positioned above the outer periphery of the cylinder in the region between the taker-in and the doffer, in which a fixed bend and a flexible bend are adjustably interconnected so as to define a required working path for the moveable flats whereby the spacing between the fixed bend and the adjustable bend can be adjusted to enable any desired predetermined clearance values to be pre-set between the tips of the flats and the outer periphery of the main cylinder, and including a number of setting devices which are arranged at spaced apart setting locations with respect to the working path and which operative to provide a predictable adjustment movement from the pre-set clearance values between the tips of the flats and the outer periphery of the main cylinder set by the adjustment means.

17 Claims, 5 Drawing Sheets

SETTING DEVICE FOR A CARDING ENGINE

BACKGROUND OF THE INVENTION

This invention relates to a setting device for a carding engine having a main toothed cylinder and a revolving flats assembly comprising flats which are moveable along a working path adjacent to the outer periphery of the main cylinder to carry out a carding operation in cooperation with the teeth of the cylinder, and to a method of adjusting the setting of the clearances between the flats and the main cylinder.

The invention is particularly applicable to a "cotton card", though of course other fibrous feed stock than cotton can be carded on such carding engines, including synthetics.

It is very important to set-up and to maintain pre-set clearances between the tips of the teeth of the cylinder and the "flats" so that efficient carding operations can be carried out, and typical clearances for cotton feed stock may be of the order of 0.10 inches, whereas clearances of the order of 0.02 inches, for example, may be suitable for some synthetics.

It is also important to obtain substantially uniform clearance between all parts of the cylinder surface and the revolving flats as they cooperate along the working path, and this can only be achieved by the adoption of suitable manufacturing standards in the manufacture and assembly of the cylinder and the wire clothing thereon and also of the flats. However, the setting of any particular clearances required for any given operation is carried out at present by relatively unsophisticated techniques on site.

The working path of the revolving flat assembly is usually defined by a so-called "flexible bend" on which run support rollers or slides which support the movement of the flats. The flexible bend is curved to correspond with the curvature of the cylinder, but small adjustments along the length of the flexible bend in radial spacing from the axis of the cylinder are usually required to obtain desired clearances.

The setting of the clearances is usually carried out by use of "feeler gauges" inserted between the flats and the cylinder periphery at different positions along the working path, and necessary small radial adjustments of the flexible bend are then made along its length to obtain the required flats/cylinder clearances. However, inevitably the quality of the setting operation can vary from one operator to another, by reason of the nature of the task, in that the feeler gauge is being inserted into the gap between the tips of wire teeth and the way in which the operation is carried out can give different results of measured clearance between one operator and another, i.e. one operator may tend to force the gauge into the clearance gap whereas another may be satisfied with a looser fit. Also, the wires on the "flats" are usually more flexible than the wires on the cylinder, and therefore the setting operation is very much dependent upon operator skill and attention or individual "feel", and this makes the setting operations unpredictable, varying from one operator to another.

The adjustment usually takes place at setting points (usually five) acting between a fixed part of the carding engine, usually a so-called "fixed bend", and the flexible bend. Once the adjustments have been completed, the carding engine can then be operated for substantial periods. However, over a period of time, wear takes place (especially of the flats wires), and re-grinding then becomes necessary, and it then becomes essential to re-set the clearances to take into account the re-grinding which has taken place.

Furthermore, modern equipment may require closer settings, and there is therefore an additional need to de-skill the setting operations and take away the present reliance upon individual skill and attention or "feel" of the operative carrying out the setting operation.

Also, in the event of a requirement to adjust the clearances set for one type of feed stock, e.g. cotton, to say synthetics, a different clearance has to be set. Using existing techniques, this requires a complete re-setting operation using feeler gauges as described above. This is a time consuming task, and represents significant "down time", especially when converting the carding engine to operate with a different type of feed stock. In addition, there is the remaining dependency of the accuracy of the clearance set being dependent on individual operator skill and attention given to the task.

Finally, there is at present an unfulfilled requirement by operators of carding engines for provision of quick and reliable adjustment of pre-set flats clearances.

SUMMARY OF THE INVENTION

The present invention therefore seeks to provide means whereby improved setting of the flats clearances can be achieved, and which is more consistently achievable and with less reliance upon the need for operator skill and attention.

According to a first aspect of the invention there is provided a carding engine comprising: a main toothed cylinder; a revolving flats assembly comprising flats which are movable along a working path adjacent to the outer periphery of the main cylinder in order to carry out a carding operation in co-operation with the teeth of the cylinder; a fixed bend and an adjustable bend which are adjustably interconnected so as to define a required working path for the movable flats in which the spacing between the fixed bend and the adjustable bend can be adjusted to enable any desired predetermined clearance values to be pre-set between the tips of the flats and the outer periphery of the main cylinder; and a number of setting devices which are arranged at spaced apart setting locations with respect to the working path and which are of a type such that, for a given indicated adjustment there is a predictable adjustment movement of the flats clearances.

According to a second aspect of the invention there is provided a carding engine comprising: a main toothed cylinder; a revolving flats assembly comprising flats which are movable along a working path adjacent to the outer periphery of the main cylinder in order to carry out a carding operation in co-operation with the teeth of the cylinder; a fixed bend and an adjustable bend which are adjustably interconnected so as to define a required working path for the movable flats; adjustment means operative to vary the spacing between the fixed bend and the adjustable bend so as to enable any desired predetermined clearance values to be pre-set between the tips of the flats and the outer periphery of the main cylinder; and a number of setting devices which are arranged at spaced apart setting locations with respect to the working path and which are of a type such that, for a given indicated adjustment there is a predictable adjustment movement from the pre-set values of the flats clearances.

Preferably, each setting device is mounted at a respective setting location on the adjustable bend.

Further, each setting device may have a controllable input which is indexable to provide controlled adjustment of the spacing between the fixed bend and the adjustable bend at the respective setting location.

Each controllable input may comprise an angularly adjustable input, preferably in the form of an indexable input head, but alternatively each input may comprise a linearly adjustable input which is operable to convert linear adjustment generally circumferentially of the working path into generally radial adjustment of the respective setting device relative to the fixed bend.

The setting devices may be individually adjustable, or alternatively coupled together for joint actuation.

The setting devices may be manually adjustable e.g. by use of an angularly adjustable micrometer type head, or alternatively a power operated input arrangement may be provided for the setting devices.

According to a further aspect of the invention there is provided a method of adjusting the setting of a carding engine which comprises a main toothed cylinder and a revolving flats assembly co-operating with said main cylinder and having flats which are movable along a working path adjacent to the outer periphery of the main cylinder with pre-set clearances between the flats and the outer periphery of the cylinder so as to carry out a carding operation in co-operation with the teeth of the main cylinder, said method comprising carrying out controlled adjustment of the clearances from pre-set values using setting devices which are spaced apart along the path of the movable flats and which are of a type such that, for a given indicated adjustment, there is predictable adjustment movement from the pre-set values of the flats clearances.

BRIEF DESCRIPTION OF THE DRAWINGS

Preferred embodiments of the invention will now be described in more detail below, by way of example only, with reference to the accompanying drawings, in which.

DETAILED DESCRIPTION

Figure 1:
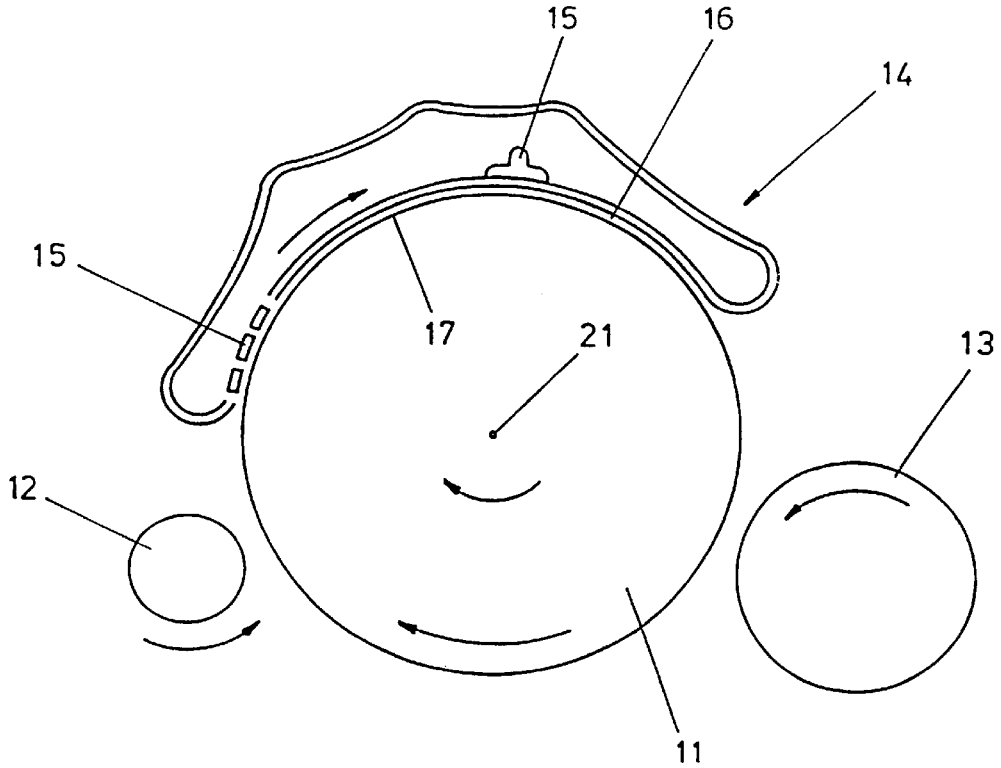
FIG. 1 (Prior Art)
FIG. 1 is a schematic illustration of a revolving-flat type carding engine to which the invention may be applied.
Figure 2:
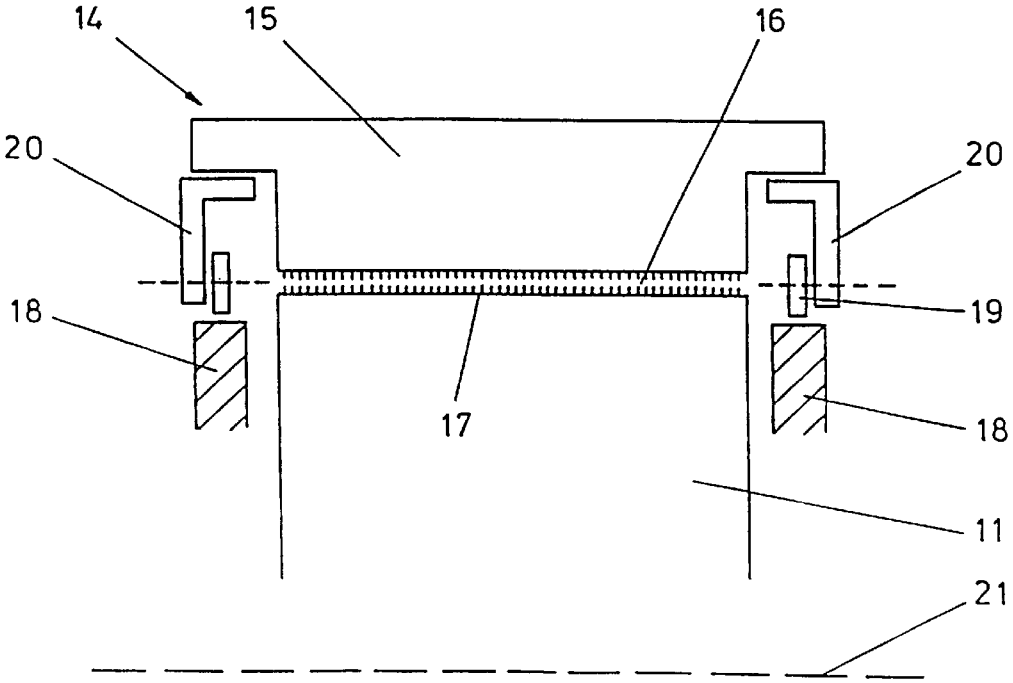
FIG. 2 (Prior Art)
FIG. 2 is a schematic illustration showing the interaction which takes place between the teeth of the moveable flats and the cylinder wire teeth in the carding engine shown in FIG. 1.

Referring first to FIGS. 1 and 2 of the drawings, there will be described an existing design of carding engine to which the invention may be applied and which is designated generally by reference 10, having a main toothed cylinder 11, a taker-in 12, a doffer 13, and a revolving flat assembly 14 positioned above the outer periphery of the cylinder 11 in the region between the taker-in 12 and the doffer 13.

The revolving flats assembly 14 comprises a series of flats 15 which are moveable along a working path 16 adjacent to the outer periphery 17 of the cylinder 11 to carry out a carding operation in cooperation with the teeth of the cylinder 11. FIG. 2 shows the way in which the movement of the flats 15 along the working path 16 is guided by use of a so-called "flexible bend" 18 on which run rollers 19 which support the flats 15 via cradles 20.

The flexible bend 18 usually comprises a number of adjacent segments and is curved to correspond with the curvature of the cylinder 11, but small adjustments will be made along the length of the flexible bend 18, in radial spacing from the axis 21 of the cylinder 11, to adjust the flats/cylinder clearance to any required value.

Figure 3:
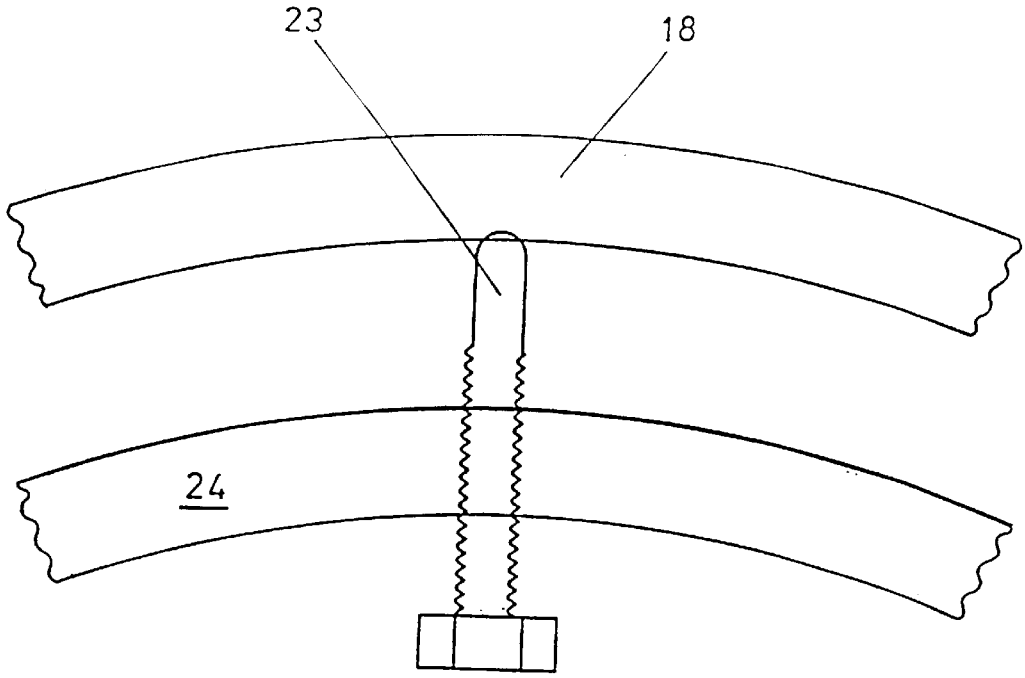
FIG. 3 is a schematic side view of part of a flats clearance setting device used in the carding engine shown in FIGS. 1 and 2.

In the carding engine in FIGS. 1 and 2, upward (or downward) adjustment of the flexible bend 18 takes place by operation of jacks 22 (see FIG. 3) which react between a fixed part of the frame of the carding engine and the flexible bend 18. Only one jack 23 is shown in FIG. 3, but it should be understood that these will be arranged at uniform spacing along the length of the flexible bend 18 to allow small increments of adjustment radially of the flexible bend 18 at desired positions along its length.

The existing practice in determining the flats/ cylinder clearance involves use of "feeler gauges" which are manually inserted between the facing tips of the teeth of the flats 15 and the cylinder 11 at various positions along the working path 16. This technique suffers from the drawbacks referred to in the introduction.

The jacks 23, or any other suitable mechanical device (not shown) comprise adjustment means which may be used to carry out initial setting of flats clearances of a carding engine according to the invention to any required pre-set or standardised values, and preferably in conjunction with a gauge, as described below. This will be done upon initial installation of the carding engine after supply by the manufacturer, and subsequently whenever required.

Figure 4:
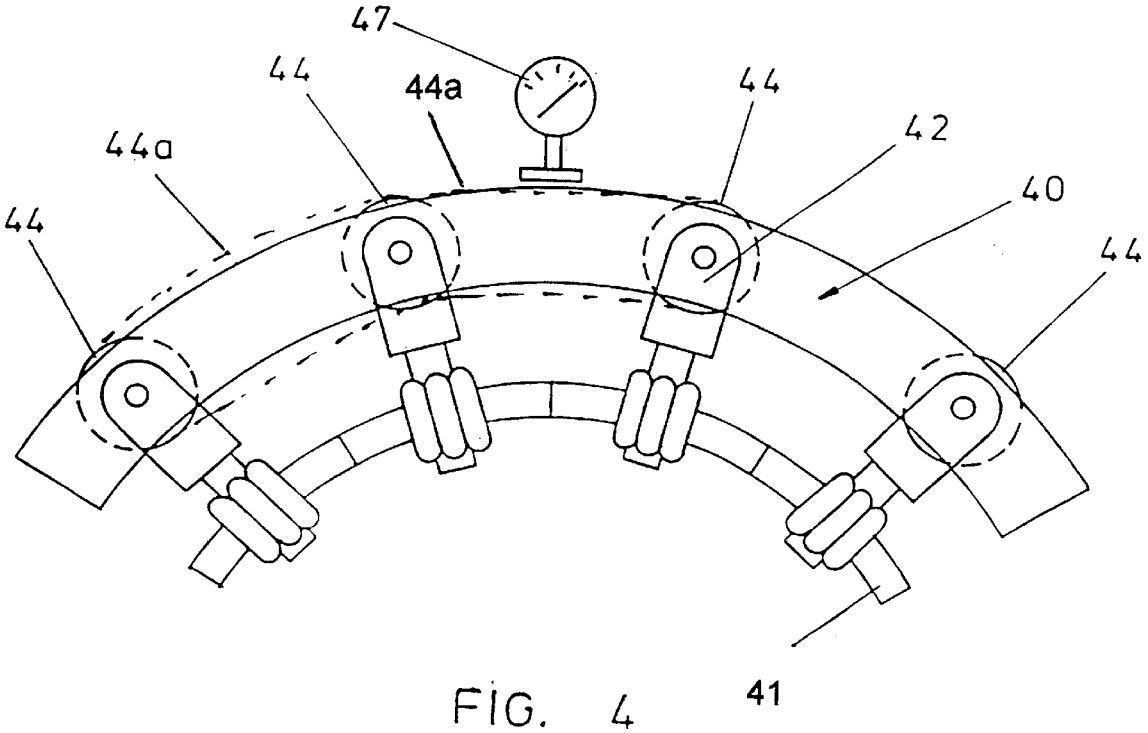
FIG. 4 is a schematic illustration of a first embodiment of the invention, having a number of adjustable flats clearance setting devices arranged along the working path of movement of the flats.
Figure 5:
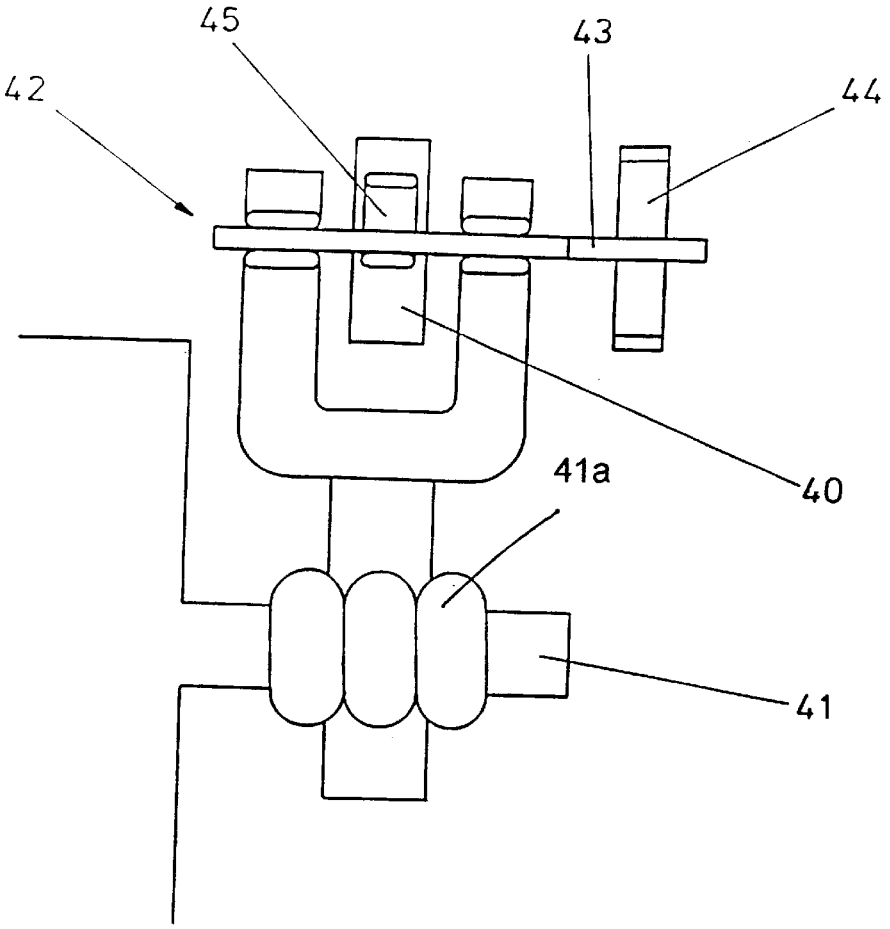
FIG. 5 is a detailed view of one of the individual setting devices of FIG. 4 in more detail.

Referring now to FIG. 4 of the drawings, this shows part of a motor driven flats clearance setting arrangement according to the invention, and comprising a usual flexible bend 40, fixed bend 41, and adjustable setting devices 42 arranged at positions spaced apart along the fixed and flexible bends, and operable to adjust the radial spacings therebetween. A gauge 47 is also illustrated, and which will be used during the initial setting-up or standardisation of the flats clearance, by operation of any suitable mechanical adjustment means 41*a* mounted on the fixed bend 41 to vary the spacing of the flexible bend 40. This will be done during initial installation of the carding engine, or subsequently whenever required. FIG. 5 is an enlarged sectional illustration of a detail part of the arrangement shown in FIG. 4, and comprises an eccentric motor driven arrangement for adjusting the setting of the flats clearances, by applying drive to adjust the setting devices 42.

The individual motor driven adjustment devices will normally be "parked" in a fixed or neutral position while the setting of the flexible bend is being standardised. Ideally, they are "parked" in such a manner that any adjustment is to increase the flats setting from an absolute minimum safe setting which has been set by gauging. Thereafter, upon application of drive to the adjusting devices, a deviation from a standard can be obtained e.g. with a standard setting of flats to cylinder equal to 0.010 inches, adjustment could be between −0.006 up to +0.015, or 0.004 setting to 0.025 inch setting. Gauge 47 is used during the calibration of the clearances, by measuring the spaces between the teeth of the cylinder and the teeth of the flats.

Each motor driven adjustment device is shown in FIG. 5, as referred to above, and either may comprise its own stepping motor, or alternatively a common drive system may be coupled with a single motor input drive, and comprising e.g. a set of belts 44*a* and pulleys 44.

Regardless of the means adopted to apply power input to the individual adjusting devices, it will be seen from FIG. 5 that each adjustment device includes a rotary adjusting shaft 43 driven by pulley wheel (or other rotary input) 44, and also includes an eccentric driving member 45. Indexed or incremental adjustment by rotation of eccentric 45 causes generally radial adjustment of the adjacent region of the flexible bend 40 relative to fixed bend 41, and consequential setting of a required flats clearance at that region.

Figure 6:
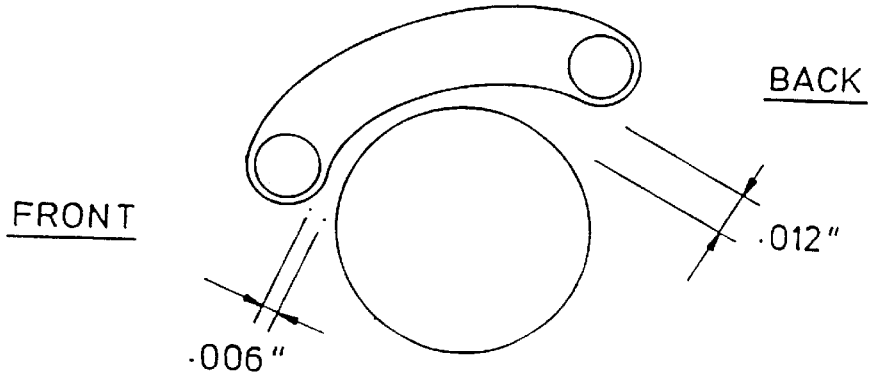
FIG. 6 is a schematic illustration of possible variation in the clearance setting of the flats along the working path which may be achieved, using the setting devices.

Referring now to FIG. 6, this shows a type of flats clearance adjustment which may be achieved using the apparatus according to the invention. If, for example a flats setting gauge 47 gives a readout directly of flat wire to cylinder wire setting, then pre-calibration may not be necessary. Also, each eccentric cam drive (45 in FIG. 5) can be driven independently by its own small motor, so that, for example, a tapered flat setting adjustment can also be obtained. Alternatively, if a flats readout is available, then continuous adjustment of the bend along the full path of the flats is possible. FIG. 6 shows one preferred mode of operation, whereby the front end of the clearance gap is set at one setting e.g. 0.006 inches, whereas the setting at the trailing end could be a larger setting e.g. 0.012 inches as shown.

Therefore, the embodiment shown in FIGS. 4 to 6 discloses a power-operated setting of the adjustment of the flats clearances, by providing incremental adjustment of a number of setting devices which are arranged at spaced apart setting locations with respect to the working path of movement of the movable flats, whereby to provide controlled adjustment of the flats clearances from clearance values which can be pre-set e.g. by use of jacks 23 upon initial installation, or subsequently.

The incremental adjustment can be obtained whenever required, e.g. when different material is to be worked, or to compensate for wear of the working parts, or as required by the operator of the carding engine. Suitable indicators (not shown) will be provided to indicate predetermined adjustment of flats clearance (from pre-set values) for each increment of adjustment of an input heat of the setting devices.

Therefore, the setting devices are of a type that, for a given indicated adjustment, there is a predictable adjustment movement from the pre-set values of the flats clearance.

FIGS. 4 to 6 disclose a power operated input arrangement for adjusting the setting devices, but the invention is not restricted to power operated adjustment of the incrementally adjustable setting devices, and which also includes purely manual input to the setting devices, either individually, or under joint actuation as required, and as will be apparent from subsequent description of further preferred embodiments of the invention.

Preferred embodiments of the present invention have the following advantages:

1. adjustment can take place while the machine is still running;

2. all of the flexible bend adjusters can be adjusted simultaneously, if required;

3. adjustment may take place in response to variation in setting monitoring e.g. as in some existing auto-monitoring arrangements;

4. adjustment can take place to suit different conditions.

Figure 7:
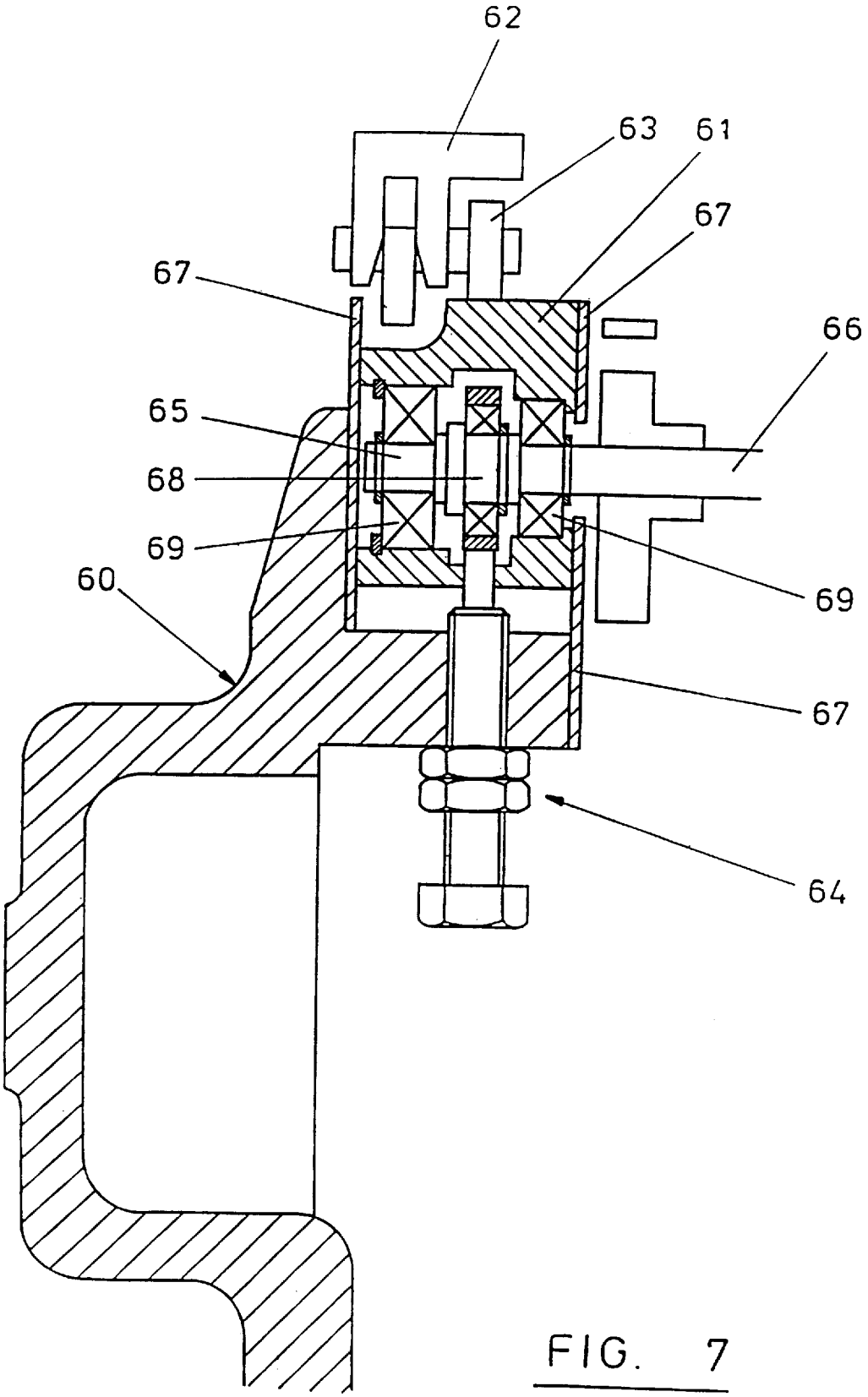
FIG. 7 is a detailed view, to an enlarged scale, of a further embodiment of incrementally adjustable setting device having a rotary indexable input head; and, FIG. 8 is a schematic side elevation of a still further embodiment of adjustable setting devices, coupled together for joint actuation via a linearly adjustable input device.

Referring now to FIG. 7 of the drawings, this shows in more detail an incrementally adjustable setting device, and in which part of the fixed bend structure is designated by reference 60, and part of a segmented or flexible bend is shown by reference 61, which defines the working path for the movable flats of the revolving flats assembly, whereby each flat, shown only schematically by reference 62, runs along the upper surface of bend 61 via guide rollers 63.

Radial adjustment of each setting location, arranged along the length of flexible bend 61, can be achieved by operation of a mechanical adjuster 64, mounted adjustably on the fixed bend structure 60, and engaging part of a bearing assembly 65 which supports the adjustment location of flexible bend 61, and also serves to provide a rotary mounting for an adjustment shaft 66. The bearing..assembly 65 and the adjustment location of flexible bend 61 are capable of joint adjustment radially of the axis of the cylinder, in guides 67 carried by the fixed bend structure 60.

Therefore, adjustment of mechanical adjuster 64 enables any desired value of initial flats clearance to be pre-set, usually upon initial installation of the carding engine, or subsequently when required. Thus, adjusters 64 perform the function of the jacks 23 (FIG. 3) referred to earlier, and are incorporated in the setting devices which enable predictable variation in flats clearances to be obtained from values pre-set by the adjusters 64. However, when it is required to carry out incremental adjustment of the clearances from the pre-set values, the setting device which is embodied within bearing assembly 65 can be operated, by incremental adjustment, to provide controlled adjustment of the flats clearances. This is achieved by controlled angular incremental adjustment of shaft 66, which can be achieved by a power input e.g. use of a stepping motor, or by manual adjustment of a micrometer type actuator head (not shown). Shaft 66 drives an eccentric portion 68, which converts incremental angular input via shaft 66 into controlled radial adjustment of the flexible bend 61 via bearings 69 carried by shaft 66 and engaging with the underside of the flexible bend 61.

Figure 8:
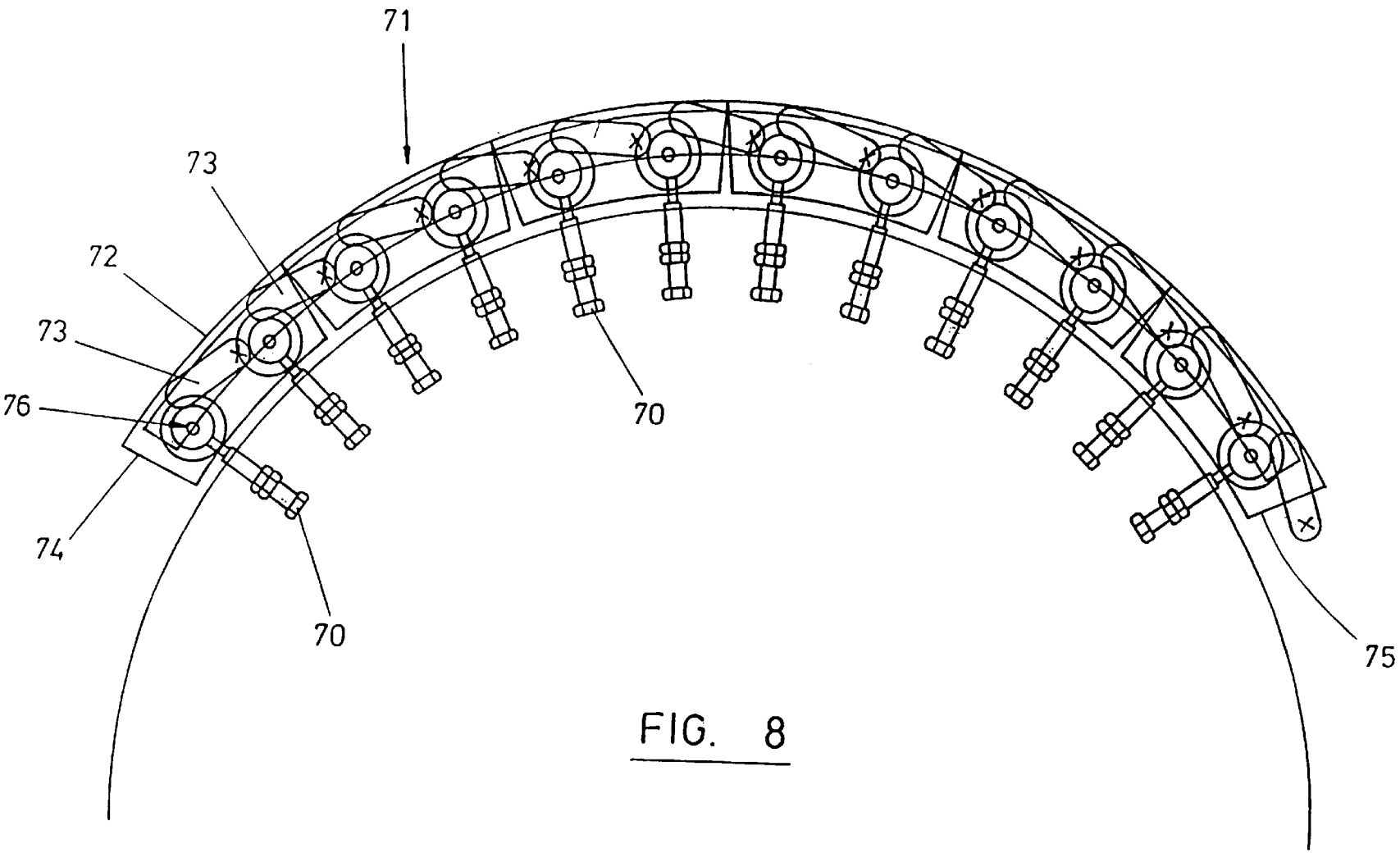

However, it should be understood that the invention is not restricted to angular incremental adjustment via an input head to the setting device, and other types of incremental input adjustment may be achieved, e.g. by use of an arrangement shown in FIG. 8.

FIG. 8 shows a series of angularly spaced mechanical adjusters 70, which react from a fixed bend structure (not shown in detail) in order to provide circumferentially spaced separate adjusting locations along the length of an adjustable bend structure shown generally by reference 71, and composed of separate bend segments 72 adjacent to each other, and adjusters 70 can be operated in order to set-up initial desired pre-set values of flats clearance along the working path of the flats. In this embodiment, individual bend segments 72 are of rigid construction, but by virtue of the possibility of individual adjustment of each segment, an effectively "flexible" bend structure is provided.

However, to provide incremental adjustability of the flats clearance settings, a linearly adjustable input arrangement is provided, and this circumferential linear adjustment along the working path is converted into generally radial adjustment of the individual setting devices and relative to the fixed bend structure. Individual bend segments 72 are interconnected by toggle links 73, and therefore circumferential input to a common linear actuator (not shown in detail) e.g. at either end 74 or 75 of the assembly of flexible bend segments 72, will result in joint radial adjustment of each segment 72. This is achieved by eccentric type adjusters 76, which carry out controlled circumferential adjustment, directly corresponding to the circumferential movement of the actuator, and by contact with an adjusting tip of each adjuster 70, this causes corresponding generally radial adjustment of the associated end of the segment 72 relative to adjuster 70.

The arrangement shown in FIG. 8 provides separate "toe" and "heel" adjustment of each flexible bend segment 72, but it is not essential to the invention to provide dual adjustment of each segment. Each segment may be carried by a cradle type structure (not shown) and which applies generally radial adjustment movement (inward or outward) of each flexible bend segment 72, as a consequence of application of circumferential and incremental input adjustment movement applied to the assembly.

In preferred embodiments of the invention, as illustrated herein, any require pre-set clearances of the flats is obtained by adjusting the spacing between the fixed bend and the adjustable bend, at intervals along their length, using mechanical adjusters e.g. 23 in FIG. 3, or 64 in FIG. 7, and generally in conjunction with use of a gauge (47). However, this invention includes the possibility of setting-up pre-set values using feeler gauge type techniques known per se.

I claim:

1. A carding engine comprising:

a main toothed cylinder;

a revolving flats assembly comprising flats which are movable along a working path adjacent to the outer periphery of the main cylinder in order to carry out a carding operation in co-operation with the teeth of the cylinder;

a fixed bend and an adjustable bend which are adjustably interconnected so as to define a required working path for the movable flats;

adjustment means operative to vary a spacing between the fixed bend and the adjustable bend so as to enable any desired predetermined clearance values to be pre-set between tips of the flats and the outer periphery of the main cylinder; and a number of setting devices which are arranged at spaced apart setting locations with respect to the working path and which are operative to provide a predictable adjustment movement from the pre-set clearance values between the tips of the flats and the outer periphery of the main cylinder set by said adjustment means.

2. A carding engine according to claim 1, in which each setting device is mounted at a respective setting location on the adjustable bend.

3. A carding engine according to claim 1, in which each setting device has a controllable input which is indexed to provide controlled adjustment of the spacing between the fixed and the adjustable bend at the respective setting location.

4. A carding engine according to claim 3, in which each controllable input comprises an angularly adjustable input.

5. A carding engine according to claim 4, in which the angularly adjustable input comprises an indexed input head.

6. A carding engine according to claim 3, in which each controllable input comprises a linearly adjustable input which is operable to convert linear adjustment generally circumferentially of the working path into generally radial adjustment of the respective setting device relative to the fixed bend.

7. A carding engine according to claim 6, in which the setting devices are coupled together for joint actuation.

8. A carding engine according to any one of the preceding claims, in which each setting device is individually adjustable.

9. A carding engine according to any one of claims 1, in which the setting devices are coupled together for joint adjustment via a single input.

10. A carding engine according to claim 8, in which the setting devices are manually adjustable.

11. A carding engine according to claim 8, including a power operated input arrangement for adjusting the setting devices.

12. A carding engine according to claim 1, in which said adjustment means comprises mechanical jacks to vary the spacing between the fixed bend and the adjustable bend at predetermined positions along the length of the adjustable bend whereby to provide preset values of flats clearances.

13. A carding engine according to any one of claim 1, including a respective adjuster incorporated in each setting device and operative to provide pre-set values of flats clearances, from which pre-set values predictable adjustment can be obtained when required by operation of the setting device(s).

14. A carding engine according to any one of claims 1, in which the adjustable bend is assembled from a plurality of individually adjustable bend elements.

15. A carding engine according to claim 14, in which each bend element is rigid.

16. A carding engine according to claim 1, in which each setting device comprises an eccentric driving member coupled to a rotary adjusting shaft driven by a rotary input which are operative to provide the predictable adjustment movement from the pre-set clearance values.

17. A carding engine according to claim 16, in which incremental rotation of the eccentric driving member causes radial adjustment of an adjacent region of the flexible bend relative to the fixed bend.

* * * * *